United States Patent [19]

Moran, Jr.

[11] 4,038,750

[45] Aug. 2, 1977

[54] SCISSORS WITH HANDLE FORMED FROM SINUSOIDAL BLANK

[76] Inventor: Joseph F. Moran, Jr., 60 W. Winona Ave., Apt. C-6, Norwood, Pa. 19074

[21] Appl. No.: 588,208

[22] Filed: June 19, 1975

Related U.S. Application Data

[63] Continuation of Ser. No. 483,458, June 26, 1974, abandoned.

[51] Int. Cl.[2] ..... B26B 13/12

[52] U.S. Cl. ..... 30/254

[58] Field of Search ..... 30/186, 254, 257, 259, 30/341; 76/104 A

[56] References Cited

U.S. PATENT DOCUMENTS

| | | | |
|---|---|---|---|
| 2,669,992 | 2/1954 | Curutchet | 30/341 X |
| 3,164,038 | 1/1965 | Ahlbin | 76/104 A |
| 3,913,422 | 10/1975 | Weber | 76/104 A |

FOREIGN PATENT DOCUMENTS

| | | | |
|---|---|---|---|
| 20,197 | 9/1896 | United Kingdom | 30/254 |

*Primary Examiner*—Al Lawrence Smith
*Assistant Examiner*—J. C. Peters
*Attorney, Agent, or Firm*—Smith, Harding, Earley & Follmer

[57] ABSTRACT

A scissors comprising a pair of halves pivotally mounted together at a medial portion, each of the halves consisting of a one-piece strip of metal having a blade portion extending in one direction from the medial portion and a handle portion extending in the other direction from the medial portion. Each scissor half is formed by stamping a blank from a flat sheet of metal, the blank having a generally sinuous portion at one end thereof for use in forming a hollow cylindrical handle portion adapted to receive a finger in the natural position and angle for applying a cutting force to the scissors. In making the scissors the cutting edge is formed on the blade portion while the blank is in the flat condition and prior to the bending and twisting operation to form the handle portion.

2 Claims, 11 Drawing Figures

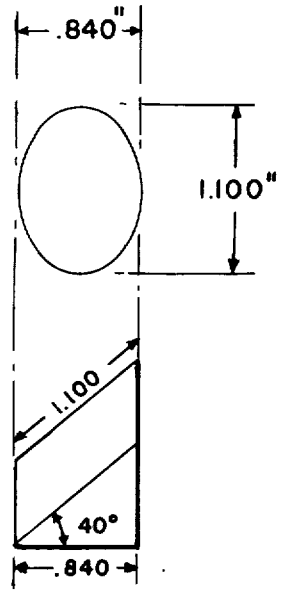
FIG. 8.
FIG.10
$$Z = \tan 40^\circ y$$
$$y = r \sin \theta$$
$$Z = \tan 40^\circ \cdot r \sin \theta$$
$$\theta = 90^\circ \times \frac{d}{1/2\, \pi r}$$
$$Z = \tan 40^\circ\, r \sin \left(90^\circ \frac{d}{1/2\, \pi r}\right)$$
$$Z = .839 \times .420 \sin \left(90^\circ \times \frac{d}{1/2 \times 3.14 \times .420}\right)$$
$$Z = .3524 \sin \left(90^\circ \times \frac{d}{.660}\right)$$
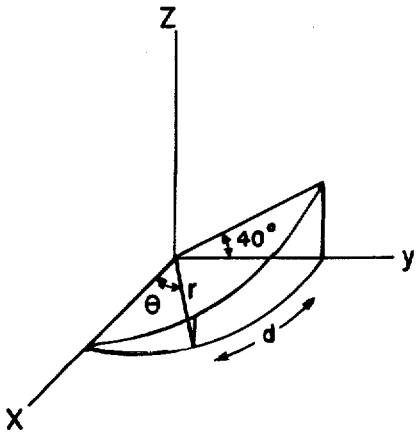
FIG. 9.
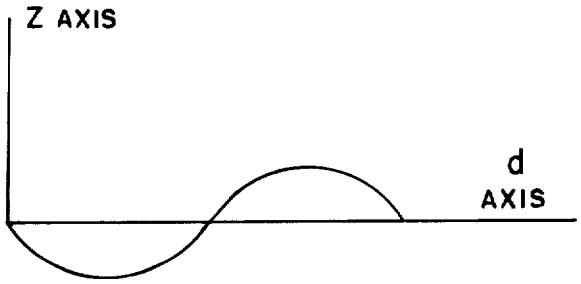
FIG. 11.

SCISSORS WITH HANDLE FORMED FROM SINUSOIDAL BLANK

CROSS-REFERENCES TO RELATED APPLICATIONS

This is a continuation of my patent application serial No. 483,458 filed June 26, 1974, now abandoned.

BACKGROUND OF THE INVENTION

This invention relates to the construction of and the method of making scissors. The great majority of scissors commercially available today are the hot forged type. These scissors are generally rather expensive for the following reasons:

1. Forging dies are expensive to make and have a relatively short life. The high temperatures and pressures wear them out quickly. They can be dressed up a few times but then must be discarded. Only highly skilled (and highly paid) die makers can make new ones.

2. Forging equipment is expensive. Because of the high pressures required, the presses must be very large. Several hits are necessary to make a forging and then it must be tirmmed. All this requires a number of machines and associated handling equipment.

3. Forging labor is high. For most products such as scissors, the process is still manual or at best, semi-automatic. There often are intermediate steps such as shearing bars to length, heating bars prior to hitting, annealing, and the like. Because of the difficult working conditions and skill required, the workmen usually are highly paid.

4. Grinding is extensive. Forging leaves a coating of scale and a very rough finish. For the most part, this has to be ground off as do other surfaces and edges. Since the shape of scissors is irregular, grinding does not lend itself to automation. The many sides, edges, curves, etc. generally have to be done manually in a number of separate steps.

5. This extensive grinding requires a high cost of grinding material and equipment.

6. Much polishing also is required. In order to prepare the scissors for plating, all ground and unground surfaces have to be carefully polished. Polishihg is very time-consuming, especially around the handle area. As with grinding, there is a substantial cost of material and equipment. It also is a manual operation.

7. Utilities cost is substantial. Heating the bar stock and the electricity required to run the large presses plus many grinders, polishers, etc. involves a significant utility cost per unit. Another important cost is the high percent of steel waste. Probably less than fifty percent of the bar stock actually is used for the final scissors because of its shape. The waste has a very low value compared to original steel cost.

For the foregoing reasons, most of the forged scissors are manufactured in low labor cost countries foreign to the United States.

Other methods presently used for scissor manufacturing generally produce the final shape of the scissors first and then follow up with the steps of grinding, polishing, plating and assembly. One such method is that of casting. However, the casting procedure is much inferior in quality to the forged scissors. Its granular micro-structure is a poor one for a cutting edge. The edges wear relatively quickly because of the granular, less dense material. Being cast, the scissors cannot flex during cutting action as do forged or some other type scissors.

This results in a stiff, hard to close tool. Althought less expensive than forging, casting does require much labor and, therefore, is done primarily in low labor cost countries. Cast scissors generally are heavy because more weight is necessary to offset the low strength.

Other than hot forging, the most popular method is cold forging and stamping. Cold forging is very similar to plain stamping except that the upper surface from point to pivot is coined or smashed to give the traditional forged appearance. Otherwise, cold forging and stamping are the same in that both involve punching the shape out of a thin, flat length of sheet metal. The process can be an automatic one and thus the labor is low. A disadvantage, however, is that the handle usually is the same thickness as the blade since it is all punched out of the same sheet. This makes for an uncomfortable pressure on the fingers during cutting. The main disadvantage is that, like forgings and castings, these types of scissors cannot be ground and polished automatically. For this reason, producers of these scissors generally do not grind any more than absolutely necessary and do very little polishing at all. The percentage of waste material is not as high as in forging but, because of the shape of the scissors is a poor one for nesting in the blank, the waste probably runs as high as forty percent. Another bad feature is the fact that these scissors usually are of lower carbon than the level required for good cutlery type edges. High carbon steel is very difficult to cold forge. It also is very difficult to punch a shape such as scissors out of high carbon steel. Producers usually use lower carbon grades in order to extend tooling and equipment life.

SUMMARY OF THE INVENTION

It is the general object of the invention to provide a new and improved scissors construction and a method of making the same.

The scissors in accordance with the invention provides an alternative to the forged scissors that offers both low cost and good quality and appearance. The scissors in accordance with the invention combines the ultimate in material and manufacturing efficiency along with a design that provides comfort features exceeding those of forged or any other type of scissors in use today. The scissors construction comprises a handle portion that conforms with the natural finger position and angle during a scissors cutting action. Moreover, the symmetry of the shape lends itself to highly automatic manufacturing along with an extremely low percentage of waste product. Also, the original blank configuration allows the use of low cost grinding, polishing and other operations necessary to produce a high quality cutting tool. The characteristics of low cost and high quality of the scissors in accordance with the invention combine to produce an improved scissors.

Briefly stated, the scissors in accordance with the invention is made by the steps of stamping from a flat sheet of metal a flat blank having a generally straight cutting portion and a curved handle forming portion, forming the cutting edge on the blade portion of the flat blank, and then forming the handle portion by bending and twisting the blank to form a hollow cylindrical portion adapted to receive a finger in the natural position and angle for the application of a cutting force to the scissors.

BRIEF DESCRIPTION OF THE DRAWINGS

FIGS. 8, 9, 10 and 11 are views illustrating the analysis used in developing the configuration of the blank used in forming the scissors in accordance with the invention.

DESCRIPTION OF THE PREFERRED EMBODIMENT

It is to be understood that the invention is not to be limited to the scope of the specific form thereof herein shown and described and that various embodiments thereof may be employed within the scope of the claims set forth hereinafter.

Figure 1:
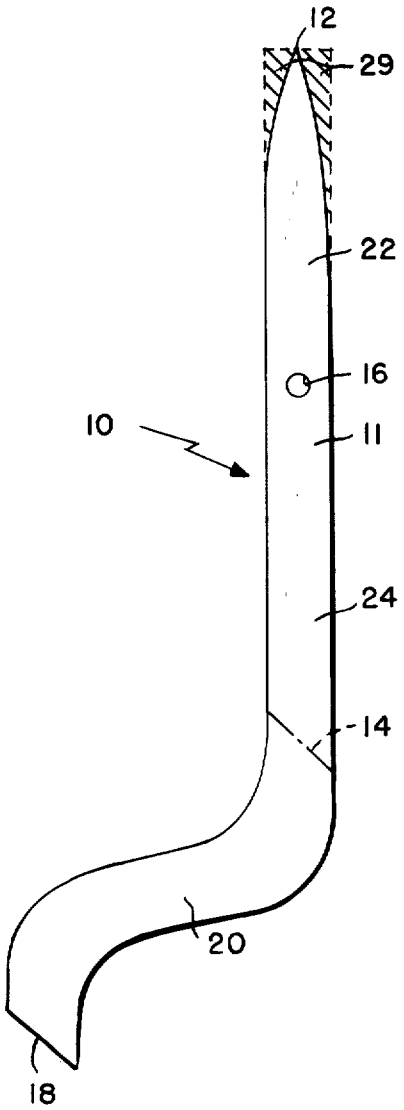
FIG. 1 is a top plan view of a blank which is used to form each half of the scissors in accordance with the invention.

Each half of the scissors in accordance with the invention is made out of a flat blank such as the one shown in FIG. 1 and indicated generally at 10 therein. The blank 10 has a straight portion 11 extending from the end 12 thereof to a location indicated by the line 14. In the middle of the straight portion of blank 10 there is punched out a hole 16 which is adapted to receive the pivot means of the scissors as will be described hereafter. The blank 10 is provided with a tail portion 20 between line 14 at the end of the straight portion and the other end 18 of the blank 10. The tail portion 20 has a sinusoidal configuration defined by the curve expressed by the formula $Z = .3524 \sin(90° \times d/.660)$ wherein $Z$ is the coordinate of the curve along the ordinate and $d$ is the coordinate of the curve along the abscissa. The manner in which this curve is determined will be described more fully hereafter.

The portion 22 of the blank 10 between the end 12 and the pivot hole 16 forms the blade of the scissors. The portion 24 of the blank 10 between the pivot hole 16 and the end 14 of the straight portion may be termed an intermediate portion. The sinusoidal tail portion 20 forms the handle of the scissors as will be described hereafter.

The blade portion 22 has a cutting edge 26 formed along one edge thereof and a back edge 28 formed along the opposite edge thereof. The cutting edge 26 and the back edge 28 converge together at the end 12 of the blank 10.

In the making of a scissors in accordance with the invention the first step is to stamp out a plurality of blanks 10 as shown in FIG. 1 from a sheet of high carbon metal. In the stamping operation the blanks 10 nest next to one another whereby the only waste is the pivot hole 16 and the area between the edges 26 and 28 of adjacent stamped blanks 10, such as is shown by the cross hatched area 29 in FIG. 1. This operation is performed on a high speed, automatic punch press. Each scissors is made of a pair of almost identical blanks 10 which form the two halves of the scissors, identical except that one scissor is more pointed than the other.

Figure 2:
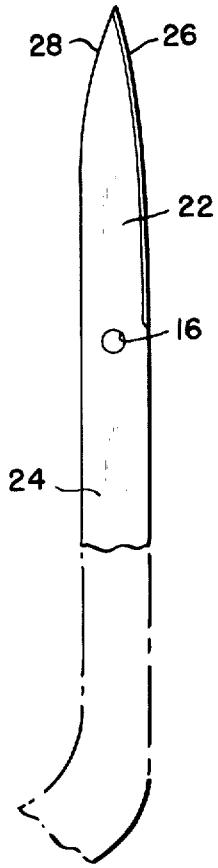
FIGS. 2 and 3 are views of a blank in intermediate stages of manufacture.

The next step in the method is for formation of the cutting edge 26 of the blank 10. This step comprises the heat treating of the cutting edge 26 and part of the body by passing the same under an oxygen-acethylene flame or by other suitable heat treating methods. The cutting edge 26 is then ground to a predetermined angle, typically 30° to the edge of the blank 10. In FIG. 2, the blade portion 22 is shown with the cutting edge 26 formed thereon. The other longitudinal edges of the blank 10 are ground to a rounded or beveled condition. The grinding steps are preferably achieved by placing the blank 10 on special moving fixtures passing grinding belts.

The next step is to grind and polish the flat sides of the blank 10, which step is achieved by placing the blank on a small moving conveyor which passes under a series of grinding belts and polishing wheels.

Figure 3:
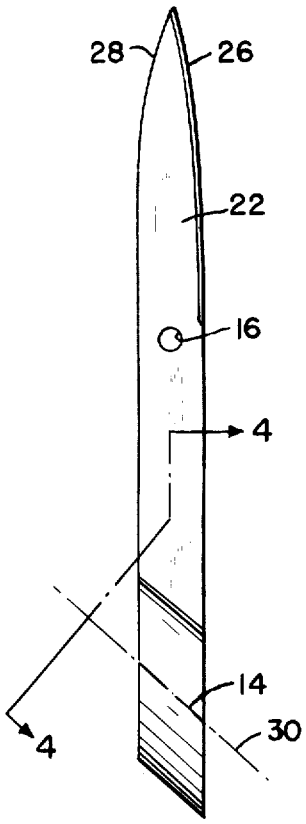
Figure 4:
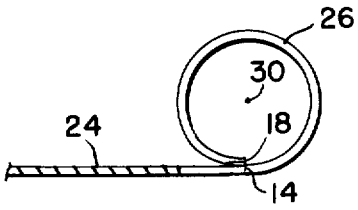
FIG. 4 is a section taken on line 4—4 of FIG. 3.

The next step in the manufacturing of the scissors is to form the handle portion of the scissors such that it conforms with the natural finger position and angle for applying a cutting force. The first stage of this step is to bend the handle-forming tail portion 20 into a loop having a hollow cylindrical configuration. This involves bending the portion 20 in a cylindrical shape with the end edge 18 being aligned with the line 14 to provide a shape as is shown in FIGS. 3 and 4. It will be apparent that the edges of the formed handle are defined by the intersection of spaced parallel planes which extend obliquely to the axis 30 of the hollow cylinder thus formed. The end edge 18 is then welded to the blank 10 along the line 14 to secure the handle in place.

Figure 5:
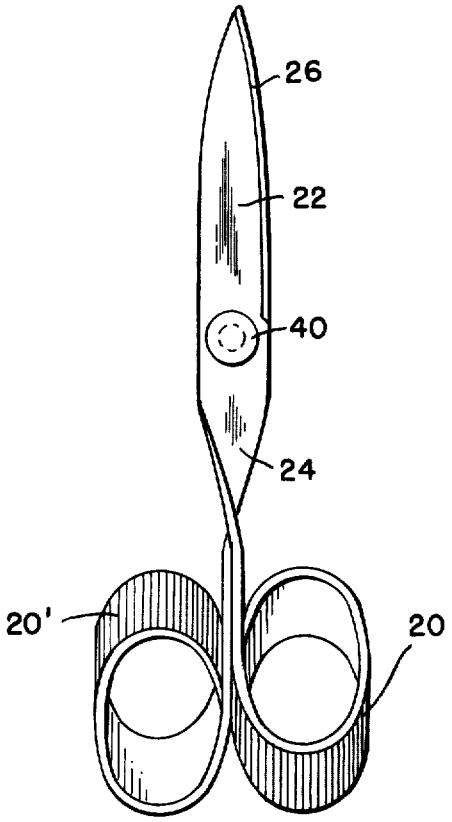
FIG. 5 is a top plan view of a scissors in accordance with the invention.
Figure 6:
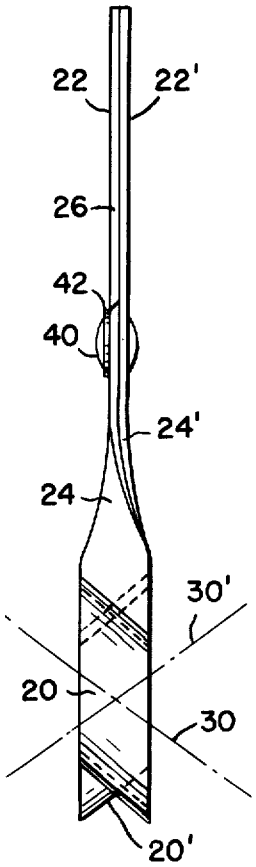
FIG. 6 is a right side view of the scissors shown in FIG. 5.

The second stage of the handle forming step comprises twisting the intermediate portion 24 of the blank 10 a quarter turn to provide a configuration best shown in FIGS. 5 and 6. The axis 30 of the hollow cylinder now extends at an oblique angle relative to the plane of the flat blade portion 22. This is best illustrated in FIG. 6. In the assembled condition of the scissors the handle provides a substantial surface area for contact with the fingers and receives the fingers in their natural position and angle for producing an effective cutting action.

During the formation of the handle, the blade portion 22 is also bowed slightly for better contact during a cutting action.

The entire scissor half is then chrome or nickel plated. This step may be eliminated in the event that a stainless steel material is used.

The above-described method is followed to make both the scissor halves. Of course, during any mass production operation, a large number of these identical scissor halves are made prior to assembly.

The next step in the making of the scissors is to assemble two identical halves of the type described above. The two scissor halves are assembled by means of a rivet 40 which is inserted through the rivet holes 16 of a pair of scissor halves which are positioned together with their cutting edges arranged to perform a cutting action. A conical spring washer 42 is placed between the rivet head and an adjacent cutting blade and the rivet 40 is spun closed with the spring washer 42 in a compressed condition. Thus, the spring washer 42 serves to bias the cutting blades together to produce a tightening tension on the scissor halves which improves the cutting action.

The final step in the manufacture is to coat the handles with plastic. In this step the handles are dipped into a plastisol material and are then baked dry.

Figure 7:
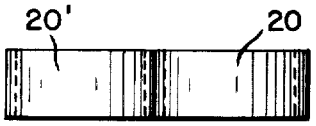
FIG. 7 is a bottom end view of the scissors shown in FIG. 5.

Referring to FIGS. 5, 6 and 7, the two scissor halves are designated with the same reference numerals with primes added to one of them. Referring to FIG. 6 it will be seen that the axes 30 and 30' of the two scissor halves extend at an oblique angle to the plane of the blade portions 22 and 22'. Moreover, these axes 30 and 30' extend in a crossed relationship. Thus, the hollow cylindrical portions provide finger receiving regions which conform to the natural finger position and angle for producing an effective cutting action. For example, if the thumb is inserted in the handle portion 20 it will extend upwardly along the axis 30. Also, another finger, such as the index finger, will be inserted downwardly in the handle portion 20' along the axis 30' to thus provide a grip whereby the fingers are in a crossed relationship extending on an oblique angle to the planes of the cutting blades 22 and 22', which position is ideal for achieving an effective cutting action and applying a cutting force to the scissors. Moreover, the handle portions provide a substantial area for receiving the applying load of the fingers, which area helps distribute the load and provides a comfortable feeling to the fingers.

Referring to FIG. 4, it will be noted that the edges of the hollow cylindrical portions provided by the bent tail portions 20 and 20' are defined by the intersection of spaced parallel planes with the enclosed hollow cylinder, which planes extend obliquely to the axis of the cylinder. Moreover, such edges are in the shape of an ellipse.

The derivation of the mathematical formula used to determine the shape of the handle forming tail portion 20 of the blank 10 will be described with reference to FIGS. 8, 9, 10 and 11. It was first determined that the diameter of the cylinder defined by the handle portion should be 0.840 inches and that the axis of this cylinder should be at an angle of 40° relative to a perpendicular axis, namely angle 0 shown in FIG. 9. It was determined that the major axis of the ellipse to be formed by the edges of the handle was 1.100 inches from the formula the cosine of 40° is equal to 0.840 divided by the major axis. This is apparent from the showing in FIG. 8 wherein the various elements are indicated.

The shape of the edge is tht of an ellipse and the various points on the ellipse are governed by the elliptical equation.

The three dimensional showing of FIG. 9 is utilized to go from the ellipse shape to the three dimensional handle configuration desired. This figure demonstrates physically the formulas shown in FIG. 10 which are used to determine the curvature of the handle portion in its originally stamped state. This produced the formula for the shape of the curve which is illustrated in FIG. 11, the formula being $Z = .3524 \sin (90° \times d/.660$ wherein Z is the ordinate and $d$ is the abscissa. This formula defines the shape of the tail portion 20 of blank 10 shown in FIG. 1 wherein the tail portion 20 has a sinusoidal shape.

I claim:

1. A scissors comprising a pair of scissor halves pivotally mounted together at a medial portion thereof, one of said scissor halves consisting of a one-piece strip of metal having a blade portion extending in one direction from said medial portion and a handle forming portion extending in the other direction of said medial portion, said blade portion being relatively flat and having a cutting edge formed thereon, said handle portion being formed into a hollow-cylinder adapted to receive a finger in the natural position and angle to the blade portion for applying a cutting force to the scissors, said handle forming portion being formed from a flat blank portion having a sinusoidal shape extending as a continuation of said medial portion is the direction of the longitudinal extent of said medial portion.

2. A scissors according to claim 1 wherein the other of said scissor halves has the same shape as said one scissor half.

* * * * *